US007823699B2

(12) United States Patent
Gieras et al.

(10) Patent No.: US 7,823,699 B2
(45) Date of Patent: Nov. 2, 2010

(54) ELECTROMAGNETICALLY OPERATED ELEVATOR DOOR LOCK

(75) Inventors: Jacek F. Gieras, Glastonbury, CT (US); Pei-Yuan Peng, Manchester, CT (US); Bryan Robert Siewert, Westbrook, CT (US); Muhidin A. Lelic, Manchester, CT (US); Gary Copsey, Gien (FR)

(73) Assignee: Otis Elevator Company, Farmington, CT (US)

( * ) Notice: Subject to any disclaimer, the term of this patent is extended or adjusted under 35 U.S.C. 154(b) by 840 days.

(21) Appl. No.: 11/570,889

(22) PCT Filed: Jul. 6, 2004

(86) PCT No.: PCT/US2004/021576

§ 371 (c)(1),
(2), (4) Date: Dec. 19, 2006

(87) PCT Pub. No.: WO2006/014164

PCT Pub. Date: Feb. 9, 2006

(65) Prior Publication Data

US 2008/0271959 A1 Nov. 6, 2008

(51) Int. Cl.

| | |
|---|---|
| ***B66B 13/02*** | (2006.01) |
| ***B66B 13/06*** | (2006.01) |
| ***E05B 47/00*** | (2006.01) |
| ***E05C 17/56*** | (2006.01) |

(52) U.S. Cl. ..... 187/335; 187/331; 187/333; 70/276; 292/251.5

(58) Field of Classification Search ..... 187/316, 187/331, 333, 335, 336, 339; 49/116, 118, 49/120, 282, 316, 449; 70/277, 278.7, 280, 70/276; 292/251.5; *B66B 13/02, 13/06; E05B 47/02*
See application file for complete search history.

(56) References Cited

U.S. PATENT DOCUMENTS 1,344,430 A 6/1920 Wigmore et al.

(Continued)

FOREIGN PATENT DOCUMENTS

CN 2185775 Y 12/1994

(Continued)

OTHER PUBLICATIONS

Supplementary European Search Report for Application No. EP 04 75 6671 dated Apr. 6, 2010.

*Primary Examiner*—John Q Nguyen
*Assistant Examiner*—Stefan Kruer
(74) *Attorney, Agent, or Firm*—Carlson, Gaskey & Olds PC

(57) ABSTRACT

An electromagnetic door lock assembly (30) includes a first portion (32) supported relative to hoistway doors (22) and a second portion (34) supported for movement with an elevator car (24). The first and second portions cooperate so that electromagnetic interaction between them unlocks a set of hoistway doors (22) for access to the car (24), for example. In disclosed embodiments, a first portion (32) of the actuator has at least one stationary electromagnetic portion (36A, 36B) and at least one moveable portion (38). The second portion (34) that moves with the car (24) includes at least one stationary electromagnetic portion (44). Magnetic interaction between the first and second portions (32, 34) causes selected movement of the moveable portion (38) for selectively locking or unlocking the doors (22).

10 Claims, 3 Drawing Sheets

U.S. PATENT DOCUMENTS

| | | | | | |
|---|---|---|---|---|---|
| 1,736,805 | A | * | 11/1929 | Simmons et al. | 187/280 |
| 3,413,026 | A | * | 11/1968 | Kendrick et al. | 292/144 |
| 3,554,326 | A | | 1/1971 | Hallene et al. | |
| 3,638,762 | A | | 2/1972 | Johns | |
| 4,009,767 | A | * | 3/1977 | Stadigh | 187/280 |
| 4,410,067 | A | | 10/1983 | Leiner et al. | |
| 4,934,488 | A | | 6/1990 | Umemura | |
| 5,174,417 | A | | 12/1992 | Pilsbury | |
| 5,476,157 | A | | 12/1995 | Todaro | |
| 5,655,627 | A | * | 8/1997 | Horne et al. | 187/335 |
| 5,730,254 | A | | 3/1998 | Nguyen | |
| 5,819,877 | A | | 10/1998 | Rivera et al. | |
| 5,894,911 | A | * | 4/1999 | Bozogzadeh et al. | 187/335 |
| 6,006,866 | A | | 12/1999 | Horne et al. | |
| 6,021,871 | A | | 2/2000 | Grabner | |
| 6,070,700 | A | | 6/2000 | Nagel | |
| 6,446,759 | B1 | | 9/2002 | Kulak et al. | |
| 6,467,585 | B1 | | 10/2002 | Gozzo et al. | |
| 6,495,821 | B1 | | 12/2002 | Smith et al. | |
| 6,732,839 | B2 | | 5/2004 | Schuster | |
| 2004/0055829 | A1 | | 3/2004 | Morris et al. | |

FOREIGN PATENT DOCUMENTS

| | | | | |
|---|---|---|---|---|
| FR | 2814162 | A1 | | 3/2002 |
| JP | 3102091 | | | 4/1991 |
| JP | 05338973 | A | * | 12/1993 |
| WO | 2006009536 | A3 | | 1/2006 |
| WO | 2006009547 | A1 | | 1/2006 |
| WO | 2006036146 | A1 | | 4/2006 |
| WO | 2006041450 | A2 | | 4/2006 |

* cited by examiner

ELECTROMAGNETICALLY OPERATED ELEVATOR DOOR LOCK

FIELD OF THE INVENTION

This invention generally relates to elevator systems. More particularly, this invention relates to door locking systems for elevators.

DESCRIPTION OF THE RELATED ART

Elevators typically include a car that moves vertically through a hoistway between different levels of a building. At each level or landing, a set of hoistway doors are arranged to close off the hoistway when the elevator car is not at that landing and to open with doors on the car to allow access to or from the elevator car when it is at the landing. It is necessary to have the hoistway doors locked when the car is in motion or not appropriately positioned at a landing to prevent an individual from opening the hoistway doors, exposing the hoistway. Conventional arrangements include mechanical locks for keeping the hoistway doors locked under appropriate conditions.

Conventional arrangements include a door interlock that typically integrates several functions into a single device. The interlocks lock the hoistway doors, sense that the hoistway doors are locked and couple the hoistway doors to the car doors for opening purposes. While such integration of multiple functions provides lower material costs, there are significant design challenges presented by conventional arrangements. For example, the locking and sensing functions must be precise to satisfy codes. The coupling function, on the other hand, requires a significant amount of tolerance to accommodate variations in the position of the car doors relative to the hoistway doors. While these two functions are typically integrated into a single device, their design implications are usually competing with each other.

The competing considerations associated with conventional interlock arrangements results in a significant number of call backs or maintenance requests. It is believed that elevator door system components account for approximately 50% of elevator maintenance requests and 30% of callbacks. Almost half of the callbacks due to a door system malfunction are related to one of the interlock functions.

There is a need in the industry for an improved arrangement that provides the security of a locked hoistway door, yet avoids the complexities of conventional arrangements and provides a more reliable arrangement that has reduced need for maintenance. This invention addresses that need with a unique elevator door lock assembly.

SUMMARY OF THE INVENTION

An exemplary embodiment of this invention is an elevator door lock assembly that includes an electromagnetic actuator that selectively locks or unlocks the assembly.

In one example, a locking member for locking a hoistway door is moved between a locking position and an unlocked position by the electromagnetic actuator. In this example, the electromagnetic actuator includes a first electromagnetic member supported for movement with an elevator car. A second electromagnetic member is associated with the locking member. Magnetic interaction between the first and second members when the elevator car is appropriately positioned relative to the hoistway doors is operative to move the locking member in a selected direction.

In one example, the first and second electromagnetic members are ferromagnetic cores and a magnetic flux in one of the cores influences the other and causes movement of the locking member responsive to the presence of the magnetic flux. By appropriately controlling power to the assembly, the magnetic flux can be controlled and the door lock can be manipulated into an opened or closed position in a reliable manner.

The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENTS

Figure 1:
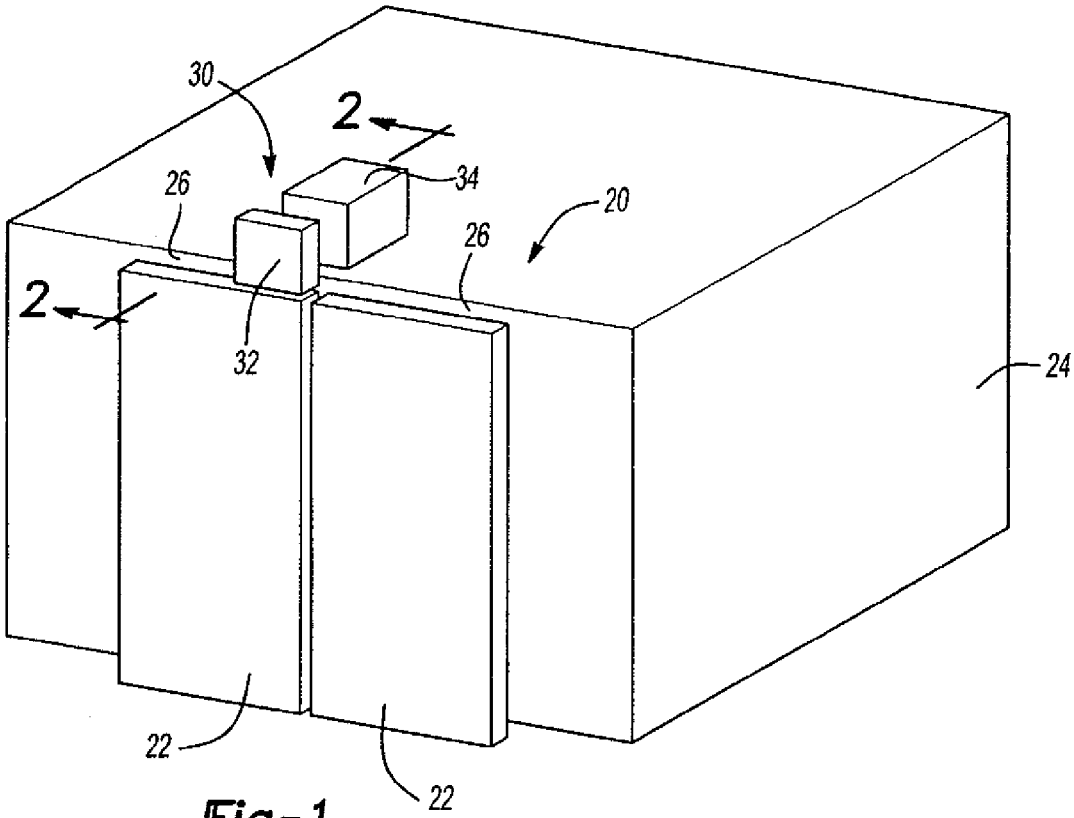
FIG. 1 schematically illustrates selected portions of an elevator car and associated hoistway doors.

FIG. 1 schematically shows an elevator door assembly 20 that includes hoistway doors 22 that are supported in a known manner at a landing within a building, for example. An elevator car 24 includes car doors 26 that cooperate with the hoistway doors 22 to provide access to the car 24 when it is appropriately positioned at the landing.

The example embodiment includes an electromagnetic door lock assembly 30 having an electromagnetic actuator for selectively locking or unlocking the hoistway doors 22. As schematically shown in FIG. 1, a first portion 32 is supported relative to the hoistway doors 22 to remain at the landing. A second portion 34 is supported for movement with the car (24 through a hoistway, for example. In one example, the second portion 34 is supported on a portion of the car frame. Other examples include supporting the second portion 34 on the cabin structure or as part of the door operator components.

When the second portion 34 and the first portion 32 are appropriately aligned (i.e., when the car 24 is properly positioned at the landing), the electromagnetic actuator controls the operating condition of the door lock assembly 30. In a discussed example, the electromagnetic actuator unlocks the door assembly to provide access to or from the car 24.

Figure 2:
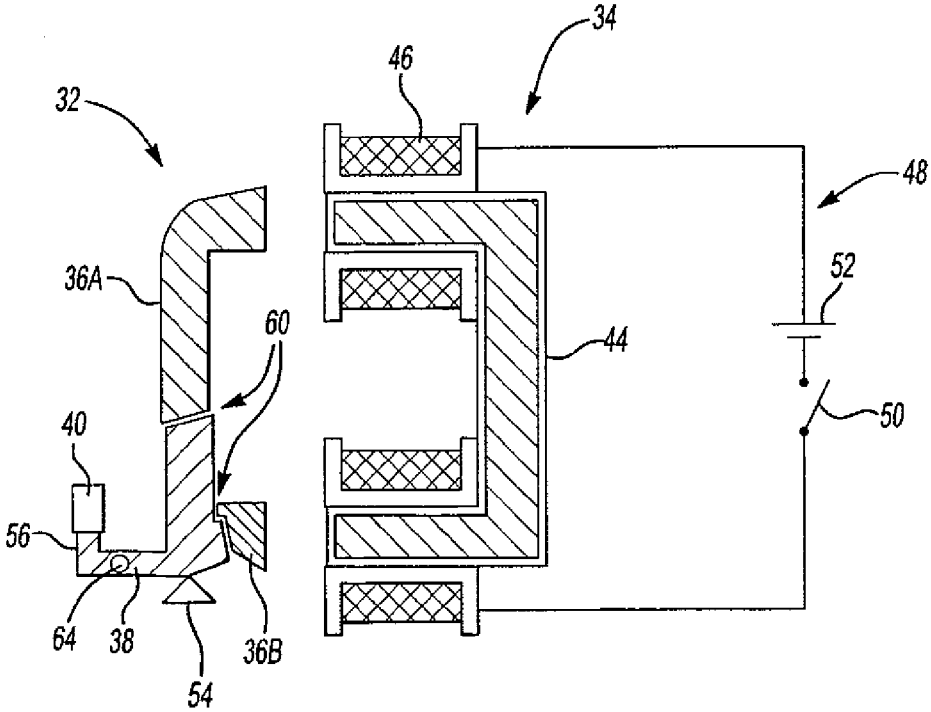
FIG. 2 is a partial cross-sectional view of an electromagnetic actuator as included in the embodiment of FIG. 1 taken along the lines 2-2 in FIG. 1.

Referring to FIG. 2, one example embodiment of an electromagnetic door lock assembly 30 is shown. The first portion 32 has at least one stationary electromagnetic portion and a moveable portion. In this example, two stationary portions 36A and 36B are positioned relative to a moveable portion 38 to facilitate door lock operation as will be described. In one example, the stationary portions 36A and 36B and the moveable portion 38 comprise magnetic cores. In one example, the magnetic cores are made of a ferromagnetic material. In a specific example, the cores are made from steel.

The moveable portion 38 cooperates with a strike member 40 that provides a door lock function to prevent the hoistway doors 22 from being opened under appropriate conditions. The moveable portion 38 in this example acts as a latch member that cooperates with the strike member 40 for selectively locking the doors.

In the example of FIG. 2, the second portion 34 includes another electromagnetic member 44, which in this example is another magnetic core. In one example, the electromagnetic member 44 is made of a ferromagnetic material. In this example, the electromagnetic member 44 is made of steel. One example embodiment comprises steel laminations while another example comprises milled, solid steel. A coil 46 is appropriately associated with the core 44 so that current flowing through the coil 46 induces magnetic flux in the core 44 in a known manner.

The example of FIG. 2 includes a control 48 that is schematically shown as a circuit for powering the coil 46 under appropriate conditions. A switch 50 closes the loop of the example circuit so that a power source 52 is coupled with the coil 46 so that current flows through the coil 46. In one example, the source 52 is a battery dedicated to the door lock assembly 30. In another example, the power source 52 is a power source already associated with the car 24 and includes a rectifier and filter to provide appropriate DC power for current flow in the coil 46.

Figure 3:
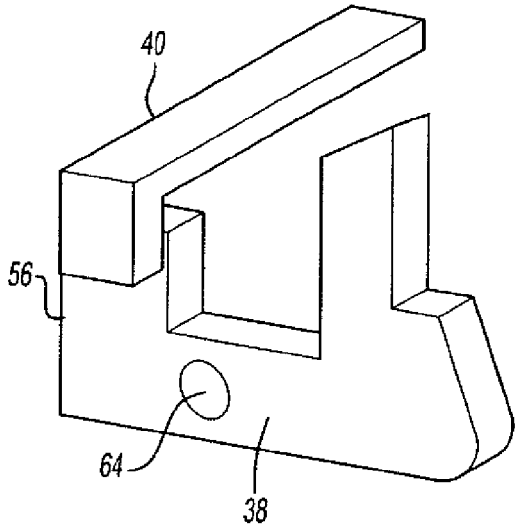
FIG. 3 is a perspective illustration schematically showing a portion of the embodiment of FIG. 2 in a locked position.

In the position shown in FIG. 2, the switch 50 is open so that no current flows through the coil 46. Accordingly, there is no magnetic flux flowing through any of the magnetic portions. In this condition, the moveable portion 38 is biased by gravity, in this example, into a locked position. As can be appreciated from FIGS. 2 and 3, the moveable portion 38 is resting on a support 54 such that a latching arm 56 is positioned to engage the strike member 40, which prevents movement of the hoistway doors 22.

Also in this condition, there are air gaps 60 between the stationary portions 36A and 36B on the one hand and the moveable portion 38 on the other hand.

Figure 5:
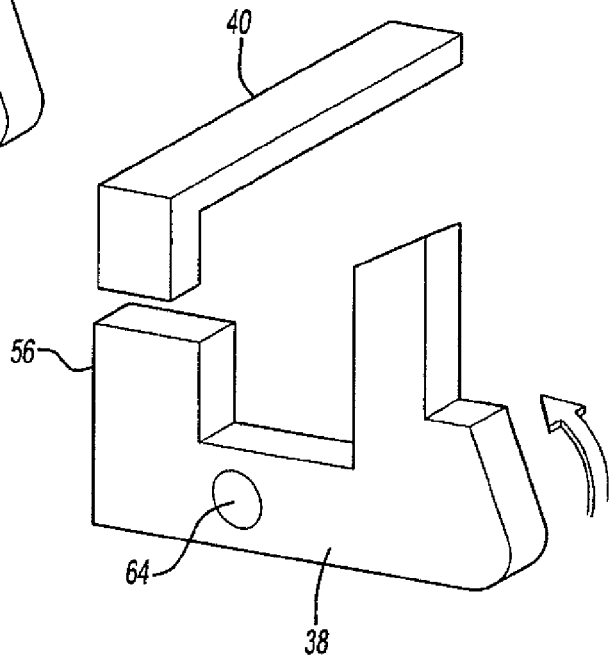
FIG. 5 is a perspective illustration corresponding to FIG. 4, schematically showing the components of FIG. 3 in an unlocked position.
Figure 4:
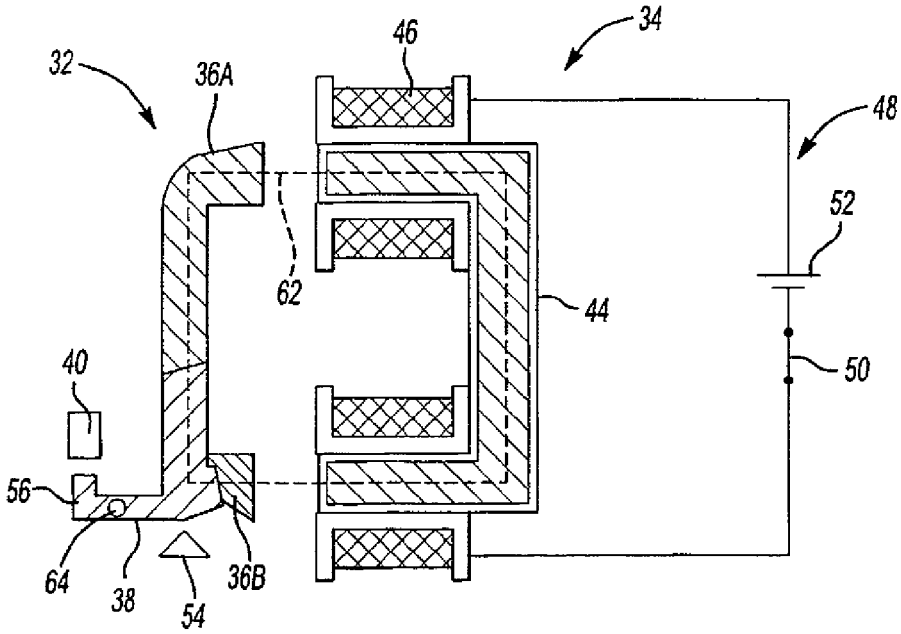
FIG. 4 is a cross-sectional illustration similar to FIG. 2 showing the example assembly in an unlocked condition.

FIG. 4 shows the embodiment of FIG. 2 with the switch 50 closed so that current flows through the coil 46. At this point magnetic flux 62 flowing through the electromagnetic member 44 and the stationary portions 36A and 36B causes movement of the moveable portion 38 into the position shown in FIGS. 4 and 5. Specifically, the magnetic flux 62 seeks a path of least resistance, which results in minimizing the air gaps 60 between the stationary portions 36A and 36B on the one hand and the moveable portion 38 on the other hand. In other words, the magnetic flux 62 causes the moveable portion 38 to move into the unlocked position shown in FIGS. 4 and 5. In this example, the moveable portion 38 pivots about a pivot axis 64 between the locked position shown in FIGS. 2 and 3 and the unlocked position shown in FIGS. 4 and 5. As can best be appreciated from FIG. 5, the latching arm 56 is clear of the strike member 40 so that the lock does not prevent movement of the hoistway doors 22.

In this example, the switch 50 is closed responsive to the car 24 arriving at the landing and responding to a call, for example so that the car doors 26 will open. In order for the hoistway doors 22 to open, the lock assembly 30 must be unlocked and the magnetic cooperation between the first portion 32 and the second portion 34 unlocks the doors. As can be appreciated from this example, the lock assembly 30 has an electromagnetic actuator that selectively locks the doors 22 when deenergized and unlocks the doors 22 when energized as the car is appropriately positioned, for example.

Figure 6:
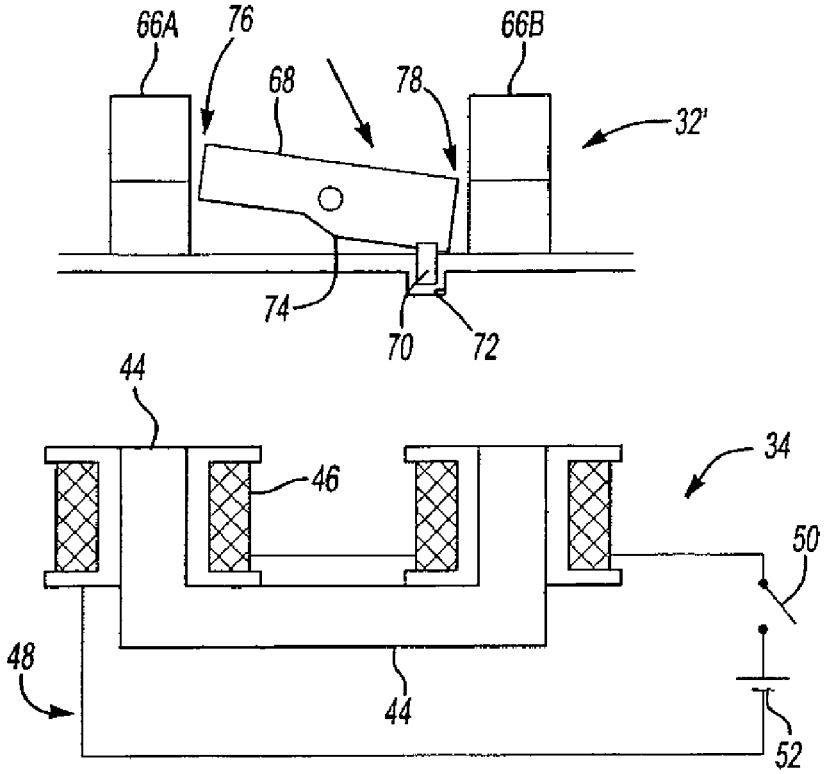
FIG. 6 is a partial cross-sectional illustration of another example embodiment in a locked condition.
Figure 7:
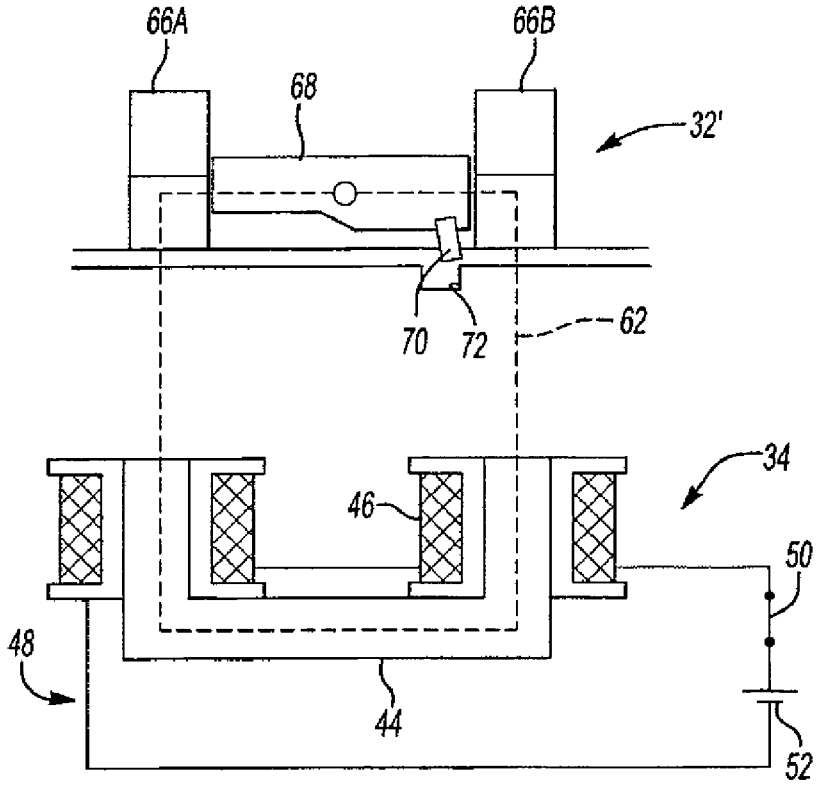
FIG. 7 shows the embodiment of FIG. 6 in an unlocked condition.

FIGS. 6 and 7 show another example embodiment. In this example, the first portion 32' includes a different configuration of stationary and moving portions. In this example, stationary magnetic portions 66A and 66B are positioned relative to an armature 68 that effectively rotates between a locked position shown in FIG. 6 and an unlocked position shown in FIG. 7. In this example, when the switch 50 is closed, the flux 62 causes the armature 68 to move into a generally horizontal position as shown in FIG. 7 so that a locking bolt 70 is removed from a striker recess 72, allowing the doors 22 to be moved. The magnetic flux 62 causes the armature 68 to move into the position shown in FIG. 7 to minimize the air gaps 76 and 78 between the armature 68 and the stationary portions 66A and 661, respectively.

In this example, the end 74 of the armature 68 associated with the locking bolt 70 is heavier than an opposite end so that the armature 68 is biased by gravity into the locked position shown in FIG. 6 whenever the coil 46 is not energized.

Some embodiments have single actuators and locking members like the disclosed examples that are the exclusive locking mechanism. Other examples include more than one locking member, more than one actuator or more than one of both. Choosing an appropriate number will become apparent to one skilled in the art who has the benefit of this description to satisfy packaging constraints or redundancy criteria, for example.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An assembly, comprising:

an electromagnetic elevator door lock actuator including a locking member for locking an elevator door and a moveable portion that moves the locking member from a locked position into an unlocked position responsive to a magnetic flux induced in at least the moveable portion;

a first portion associated with the locking member and a second portion supported for movement with an elevator car, and wherein magnetic interaction between the first and second portions is operative to induce the magnetic flux in the moveable portion, wherein the first portion has a stationary portion and the moveable portion is moveable between a first position relative to the stationary portion corresponding to one of the locked position or the unlocked position of the assembly and a second position relative to the stationary portion corresponding to the other of the locked position or the unlocked position of the assembly and wherein the magnetic interaction is operative to move the moveable portion from the first position to the second position, wherein the magnetic interaction comprises the induced magnetic flux in the moveable portion and an induced magnetic flux in the stationary portion, and wherein the second position includes a minimum air gap between the stationary portion and the moveable portion and the first position includes a greater air gap, and wherein the first and second portions each comprises a magnetic core.

2. The assembly of claim 1, including a winding associated with the second portion and wherein current in the winding induces the magnetic flux in the first portion that causes the moveable portion to move into the second position.

3. The assembly of claim 1, wherein the locking member is biased into the locked position and the induced magnetic flux moves the locking member against the bias.

4. The assembly of claim 2, including a switch that controls current supply to the winding responsive to the first portion being in a selected position relative to the second portion.

5. An assembly, comprising:

an electromagnetic elevator door lock actuator including a locking member for locking an elevator door and a moveable portion that moves the locking member between a locked and an unlocked position responsive to a magnetic flux induced in at least the moveable portion, including a first portion associated with the locking member and a second portion supported for movement with an elevator car, and wherein magnetic interaction between the first and second portions is operative to induce the magnetic flux in the moveable portion, wherein the first portion has a stationary portion and the moveable portion is moveable between a first position relative to the stationary portion corresponding to one of the locked position or the unlocked position of the assembly and a second position relative to the stationary portion corresponding to the other of the locked position or the unlocked position of the assembly, wherein the magnetic interaction is operative to move the moveable portion from the first position to the second position, wherein the moveable portion moves relative to the stationary portion responsive to the induced magnetic flux to minimize any spacing between at least a part of the moveable portion and a corresponding part of the stationary portion, and wherein the first and second portions each comprise a magnetic core.

6. The assembly of claim 5, comprising two stationary portions and wherein the magnetic flux is induced in the stationary portions.

7. The assembly of claim 6, wherein the elevator door comprises at least one hoistway door and wherein the locking member locked position is where the locking member is operative to prevent movement of the hoistway door from a closed position.

8. The assembly of claim 7, including at least one elevator car door that is selectively moveable into a generally aligned position with the hoistway door and wherein the electromagnetic elevator door lock actuator includes a first portion associated with the hoistway door and a second portion associated with the elevator car door and wherein the magnetic flux is associated with the first and second portions.

9. The assembly of claim 8, wherein the magnetic flux becomes operative to move the locking member when the car door is in the generally aligned position.

10. The assembly of claim 9, including a winding associated with the second portion and a control that controls a supply of current to the winding responsive to the car door being in the generally aligned position.

* * * * *